United States Patent [19]

Eggers

[11] Patent Number: 4,463,282

[45] Date of Patent: Jul. 31, 1984

[54] FLASH LAMP

[75] Inventor: Fredrick W. Eggers, Palos Heights, Ill.

[73] Assignee: Federal Signal Corporation, Oakbrook, Ill.

[21] Appl. No.: 376,752

[22] Filed: May 10, 1982

[51] Int. Cl.[3] ..... H01J 7/44; H01J 17/34; H01J 19/78; H01J 29/96

[52] U.S. Cl. ..... 315/70; 340/331; 313/512; 313/601; 315/200 A; 315/57

[58] Field of Search ..... 340/331; 362/200, 204; 313/512, 601, 602; 315/57, 70, 241 S, 200 A

[56] References Cited

U.S. PATENT DOCUMENTS

| | | | |
|---|---|---|---|
| 1,161,840 | 11/1915 | Campbell . | |
| 1,820,027 | 8/1931 | McClintock . | |
| 2,066,145 | 12/1936 | Fink et al. | 340/331 |
| 2,712,095 | 6/1955 | Noel . | |
| 2,905,863 | 9/1959 | Martin et al. | 315/241 S |
| 3,530,501 | 9/1970 | Van Benschoten | 340/331 |
| 3,551,736 | 12/1970 | Doehner . | |
| 3,673,462 | 6/1972 | Girard | 315/200 A |
| 3,675,073 | 7/1972 | Hogue | 315/57 |
| 3,710,182 | 1/1973 | Van Reenen | 315/200 A |
| 3,767,969 | 10/1973 | White et al. . | |
| 3,912,968 | 10/1975 | Nakamura . | |
| 3,953,761 | 4/1976 | Giudice . | |
| 4,007,399 | 2/1977 | White . | |
| 4,142,179 | 2/1979 | Lowndes | 340/331 |
| 4,211,955 | 7/1980 | Ray | 313/512 |
| 4,251,753 | 2/1981 | Kondo . | |
| 4,256,995 | 3/1981 | Ishida . | |
| 4,271,375 | 6/1981 | Hosono . | |

*Primary Examiner*—Saxfield Chatmon

*Attorney, Agent, or Firm*—Charles F. Pigott, Jr.; George H. Gerstman

[57] ABSTRACT

A flash lamp in which a flash tube, transformer, capacitor and base are coupled together to form a unitary integral lamp. A portion of the flash tube, the transformer and capacitor may be encapsulated by a potting compound.

6 Claims, 8 Drawing Figures

FLASH LAMP

BACKGROUND OF THE INVENTION

The present invention concerns a novel flash lamp and flash lamp assembly.

In emergency lights, such as emergency vehicle light bars, incandescent lamps having a dual contact bayonet base are often used. I have discovered a flash lamp assembly that can be easily substituted for this type of incandescent lamp. It is to be understood, however, that my invention is not limited to use in emergency vehicle light bars. My invention may take various forms in which a simple flash lamp assembly is provided having a two-contact circuit in contrast to the prior art three-contact circuits.

For example, a conventional flash tube has two end contacts which may be designated an anode and a cathode for convenience, although these designations may be arbitrary. The conventional flash lamp also has a trigger electrode, often in the form of a metal band. In conventional prior art flash circuits, all three electrodes must be connected to external circuitry, and thus the prior art flash tube assemblies cannot be merely inserted into an ordinary two-contact receptacle such as used with a conventional incandescent lamp.

It is, therefore, an object of the present invention to provide a flash lamp that is insertable into an incandescent lamp receptacle.

Another object of the present invention is to provide a flash lamp in which the flash lamp assembly is formed in a unitary, integral construction.

A further object of the present invention is to provide a flash lamp assembly in which a flash tube, transformer, capacitor and base are coupled together to form a unitary, integral lamp, with all or a portion of the flash tube, the transformer and capacitor being encapsulated by a potting compound.

A further object of the present invention is to provide a flash lamp which is simple in construction and easy to manufacture.

Other objects and advantages of the present invention will become apparent as the description proceeds.

SUMMARY OF THE INVENTION

In accordance with the present invention, a flash lamp is provided which comprises a flash tube having an anode, a cathode and a trigger electrode. A transformer and a capacitor are electrically coupled to the flash tube and a multi-contact lamp base is provided. The anode of the flash tube is connected to one base contact and the cathode of the flash tube is connected to another base contact. The flash tube, transformer, capacitor and base all form a unitary integral lamp.

In the illustrative embodiment, the lamp includes potting means encapsulating a portion or all of the flash tube, the transformer and the capacitor. The base has a main hollow metallic body forming a ground contact and having a single centrally-located bottom contact, with the anode connected to the bottom contact and the cathode connected to the ground contact.

In the illustrative embodiment, the flash lamp assembly comprises the flash tube, transformer, capacitor and means connecting the capacitor in series with the transformer primary. One side of the capacitor is connected to one side of the transformer primary and the other side of the capacitor is connected to either the anode or cathode. The other side of the transformer primary is connected to the other electrode of the flash tube. One side of the transformer secondary is connected to the trigger electrode of the flash tube and the other side of the transformer secondary is connected to either the anode or cathode.

A more detailed explanation of the invention is provided in the following description and claims, and is illustrated in the accompanying drawings.

DETAILED DESCRIPTION OF THE ILLUSTRATIVE EMBODIMENTS

Figure 1:
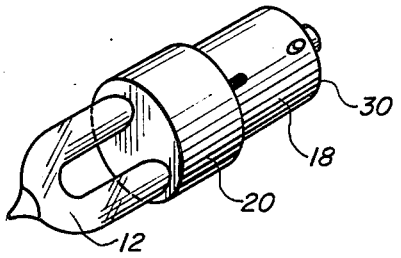
FIG. 1 is a perspective view of a flash tube constructed in accordance with the principles of the present invention.

Referring to FIGS. 1–4 of the drawings, a flash lamp 10 is shown therein comprising a flash tube 12, a transformer 14, a capacitor 16, a contact base 18 and a central body portion 20.

Flash tube 12 may comprise a conventional flash tube having a first electrode 22 which for convenience will be designated an anode, a second electrode 24 which for convenience will be designated a cathode, and a trigger electrode 26 which extends from metal trigger band 28. Although no limitation is intended, flash tube 12 may be General Electric Model FT-106C.

Transformer 14 is preferably a miniature transformer and although no limitation is intended, transformer 14 may comprise a Siemens ZS-1062 transformer. Capacitor 16 is preferably a disc ceramic capacitor and although no limitation is intended, capacitor 16 may comprise a Sprague 5GAS-S10 capacitor.

Base 18 is preferably a metal base having a pair of opposed bayonet pins 30, a centrally positioned electrical contact 32 surrounded by a non-conductive high temperature insulator 34, with the remainder of base 18 forming a ground contact.

Figure 2:
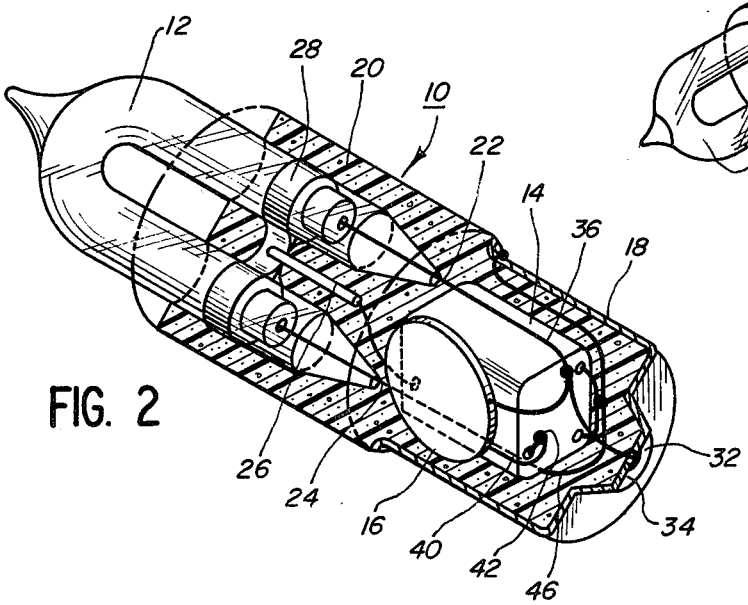
FIG. 2 is an enlarged view thereof, with portions broken away to show the interior thereof.
Figure 3:
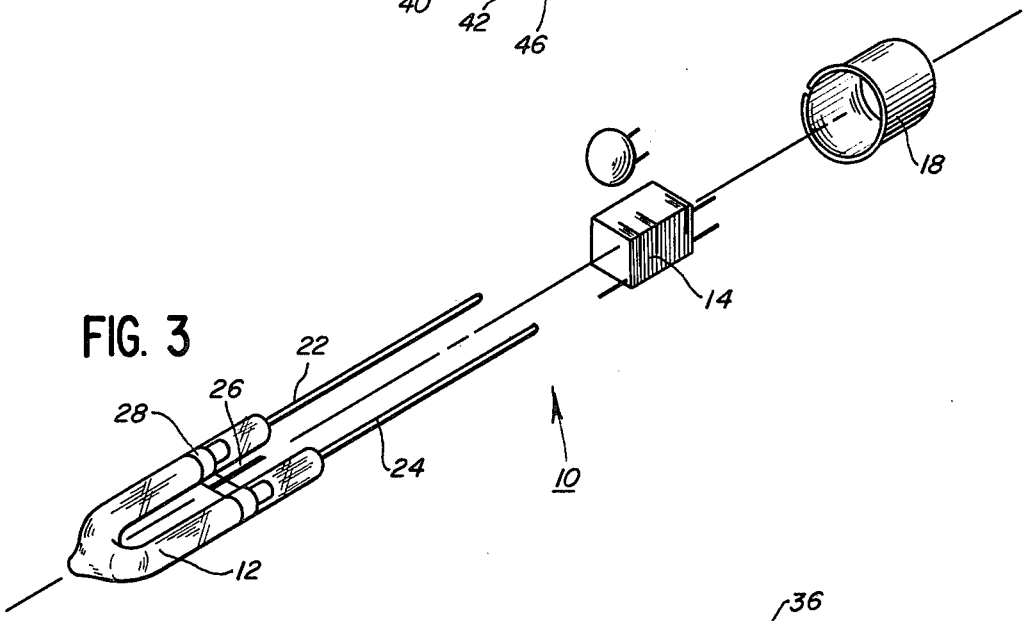
FIG. 3 is an exploded view thereof.
Figure 4:
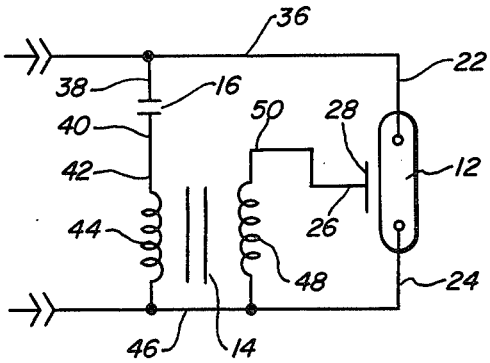
FIG. 4 is a schematic circuit diagram of a flash lamp assembly constructed in accordance with the principles of the present invention.

Referring to FIGS. 2 and 4, it can be seen that base 18 is hollow to enclose transformer 14 and capacitor 16. Electrical lead 36 couples anode 22 to lead 38 of capacitor 16 while lead 40 of capacitor 16 is connected to one side 42 of transformer primary 44. Lead 46 connects the other side of transformer primary 44 to the ground contact of base 18 and to one side of the transformer secondary 48. Lead 50 connects trigger electrode 26 to the other side of the transformer secondary 48.

Central body portion 20 is formed of a potting compound which fills hollow base 18 to encapsulate transformer 14 and capacitor 16 therewithin, and to form a portion of the housing for the flash lamp. It can be seen that the flash tube 12, transformer 14, capacitor 16, base 18 and central body portion 20 combine together to form a unitary, integral lamp 10.

Although no limitation is intended, the potting compound which forms central body portion 20 and encapsulates an epoxy resin such as "Sylgard" brand elastomer No. 184 sold by Dow Corning Corp. of Midland, Mich.

It is desirable that base 18 be a conventional incandescent lamp type two-contact bayonet base. In this manner, flash lamp 10 can be easily substituted into a conventional bayonet receptacle for incandescent lamps.

Figure 5:
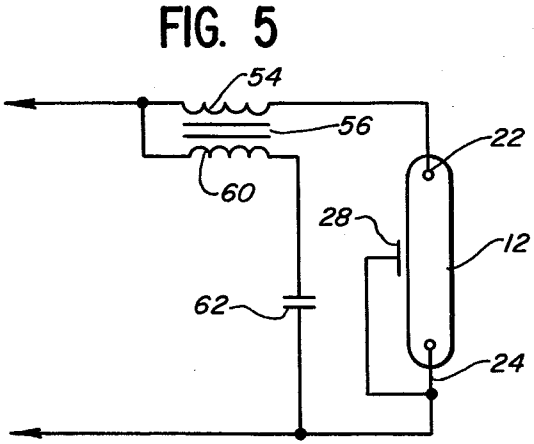

In other forms of the invention, as illustrated in FIGS. 5–8, series injection type flash tube assemblies are provided. As illustrated in FIG. 5, the flash tube anode 22 is connected in series with the primary 54 of a transformer 56, while the cathode 24 and trigger electrode 28 are connected directly to ground line 58. One side of secondary 60 of transformer 56 is connected to primary 54 and the other side of secondary 60 is connected to primary 54 and the other side of secondary 60 is connected to a capacitor 62 which is connected to ground line 58.

Figure 6:
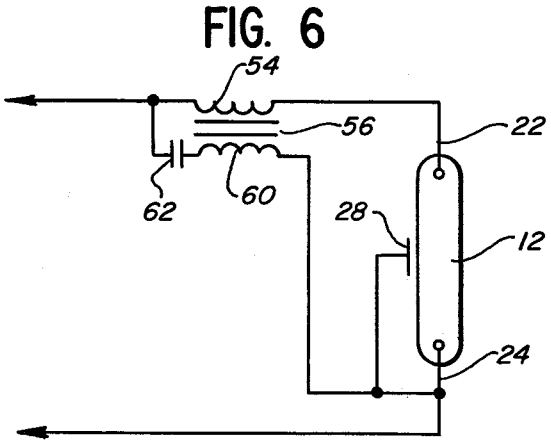
FIGS. 5–8 are schematic circuit diagrams of flash lamp assemblies constructed in accordance with modified forms of the invention.

In the embodiment of FIG. 6, which is similar to the embodiment of FIG. 5, one side of secondary 60 is connected to cathode 24 while the other side of secondary 60 is connected through capacitor 62 to primary 54.

Figure 7:
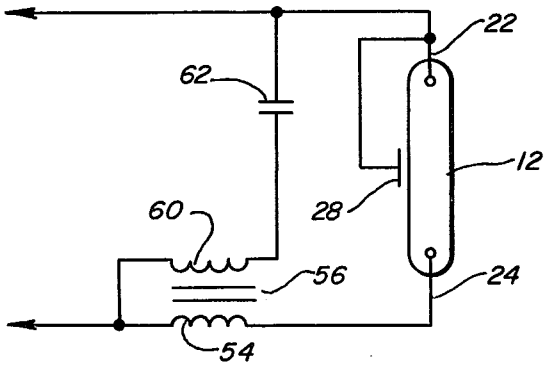

In the FIG. 7 embodiment, primary 54 is in series with cathode 24 of flash tube 12. One side of capacitor 62 is connected to anode 22 while the other side of capacitor 62 is connected to one side of secondary 60. The other side of secondary 60 is connected to primary 54.

Figure 8:
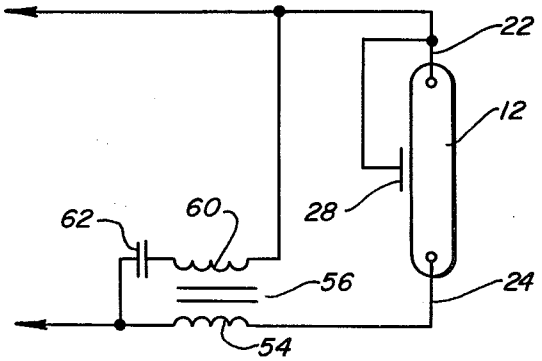

In the FIG. 8 embodiment, which is similar to the FIG. 7 embodiment, one side of secondary 60 is connected to anode 22 while the other side of secondary 60 is connected to one side of capacitor 62. The other side of capacitor 62 is connected to primary 54.

As used in the specification and claims, the terms "anode" and "cathode" are for convenience only. There is no intention for one or the other to be limited to the electrode which is connected to the ground line or the higher voltage line.

Although illustrative embodiments of the invention have been shown and described, it is to be understood that various modifications and substitutions may be made by those skilled in the art without departing from the novel spirit and scope of the present invention.

What is claimed is:

1. For use in a flash lamp assembly in which there is a direct current supply external of the flash lamp and a timing circuit external of the flash lamp, and the flash lamp relies on the external timing circuit for the timing of the flashes, a flash lamp which comprises:

a flash tube having an anode, a cathode, and a trigger electrode;

a first inlet line and a second inlet line;

a transformer having a primary and a secondary;

a capacitor in series with the primary winding of the transformer;

the capacitor and primary winding being connected across the first inlet line and second inlet line;

said transformer and capacitor circuit coupled to said anode, cathode and trigger electrode;

a multi-contact lamp base;

means connecting said first line to one base contact and said second line to another base contact;

said flash tube, transformer and capacitor circuit and said base all forming a unitary, integral lamp without the need for any timing means within the lamp, with said base being adapted for connection to the external timing circuit.

2. A device as described in claim 1, said lamp including potting means encapsulating a portion of said flash tube, said transformer and capacitor.

3. A device as described in claim 1, in which said capacitor is in series with said transformer primary, with one side of the capacitor being connected to one side of the transformer primary and the other side of the capacitor being connected to one of said anode and cathode; means connecting the other side of the transformer primary to one of said anode and cathode; means connecting one side of the transformer secondary to said trigger electrode; and means connecting the other side of the transformer secondary to one of said anode and cathode.

4. A device as described in claim 1, said base comprising a hollow substantially metal member and said transformer and capacitor circuit being located within said base.

5. A device as described in claim 1, said lamp base having a main hollow metallic body forming a ground contact and having a single centrally-located bottom contact; and means connecting said anode to said bottom contact and said cathode to said ground contact.

6. A device as described in claim 5, in which said lamp base includes a bayonet pin.

* * * * *